US006918616B2

(12) United States Patent
Lyen et al.

(10) Patent No.: US 6,918,616 B2
(45) Date of Patent: Jul. 19, 2005

(54) PRINTED SECURITY DEVICE AND METHOD

(75) Inventors: Eric A. Lyen, Ottawa (CA); Laurence M. -F. Suzzarini, Ottawa (CA)

(73) Assignee: Canadian Bank Note Company, Limited, Ottawa (CA)

( * ) Notice: Subject to any disclaimer, the term of this patent is extended or adjusted under 35 U.S.C. 154(b) by 142 days.

(21) Appl. No.: 10/260,453

(22) Filed: Sep. 27, 2002

(65) Prior Publication Data

US 2004/0061325 A1 Apr. 1, 2004

(51) Int. Cl.[7] ..... B42D 15/00

(52) U.S. Cl. ..... 283/72; 283/91; 428/42.1; 428/195.1; 428/915

(58) Field of Search ..... 283/72, 81, 91, 283/94; 428/40.1, 42.1, 195.1, 915, 916

(56) References Cited

U.S. PATENT DOCUMENTS

| | | | | |
|---|---|---|---|---|
| 4,033,059 | A | 7/1977 | Hutton et al. | |
| 4,715,623 | A | 12/1987 | Roule et al. | |
| 5,199,744 | A | 4/1993 | Shenton | |
| 5,487,567 | A * | 1/1996 | Volpe | 283/72 |
| 5,582,103 | A | 12/1996 | Tanaka et al. | |
| 5,722,693 | A | 3/1998 | Wicker | |
| 6,063,176 | A | 5/2000 | Lyen | |
| 6,082,775 | A | 7/2000 | Phillips | |
| 6,294,010 | B1 | 9/2001 | Pfaff et al. | |
| 2001/0051217 | A1 | 12/2001 | Nigam | |
| 2002/0022093 | A1 | 2/2002 | Kuntz et al. | |
| 2003/0003275 | A1 * | 1/2003 | Gration et al. | 428/195 |
| 2004/0061325 | A1 * | 4/2004 | Lyen et al. | 283/72 |

FOREIGN PATENT DOCUMENTS

| | | |
|---|---|---|
| CA | 1172282 | 8/1984 |
| CA | 2071795 | 8/1996 |

* cited by examiner

*Primary Examiner*—Monica S. Carter
(74) *Attorney, Agent, or Firm*—IPLM Group, P.A.

(57) ABSTRACT

According to one aspect of the invention, a printed security device for a document comprises an intaglio printed latent image which has been printed onto a substrate using a highly reflective ink, wherein the intaglio printed latent image is visible when viewed within a first angle range extending from near-vertical to the plane of the latent image towards the image and also within a second angle range closer to the plane of the image, and is not visible when viewed within an angle range between the first and second angle ranges. A change in viewing angle from one angle range to an adjacent angle range results in a visible latent image becoming invisible or vice versa (creating a flip-flop image visibility effect). According to another aspect of the invention a non-intaglio printed second image is added, preferably between the substrate and the intaglio printed latent image, wherein the second image is visible when viewed within an angle range between the first and second angle ranges of visibility of the intaglio printed latent image and is not visible when viewed at other angles. The flip-flop image visibility effect is thereby enhanced such that distinct images (viz. the intaglio latent image and non-intaglio image) are viewed as the viewing angle of the security device moves from near-vertical to near-horizontal angles.

19 Claims, 2 Drawing Sheets

PRINTED SECURITY DEVICE AND METHOD

FIELD OF THE INVENTION

This invention relates generally to the field of printed matter for use on documents such as documents of value (e.g. banknotes), passports, identity documents, and the like and, more particularly, to printed matter in the form of a security device, and method of making the same, configured for facilitating an authentication of the document by means of a simple, visual inspection.

BACKGROUND OF THE INVENTION

Intaglio printing is typically used for the manufacture of documents of value such as bank notes for which counterfeiting and fraudulent actions are a cause of concern. According to this printing method, a substrate such as a high grade paper is pressed against an engraved and inked plate, at very high pressure, so as to cause the substrate to deform into ink-bearing engraved recesses of the plate and thereby produce an inked impression on the substrate, the appearance of which is defined by the engravings and is difficult to replicate without using an intaglio printing press.

However, with the advent of improved technologies for photocopiers an increased risk of counterfeiting of intaglio-printed documents, using photographic techniques, has developed. These new technologies can be capable of reproducing intaglio-printed documents with sufficient quality to be able to avoiding detection by lay persons relying only on a visual inspection of the reproduced document. Consequently, there is a need for means to enable authentication of such documents through a simple visual inspection of the document (i.e. without the use of special knowledge or experience, finding screens, special lights or similar tools).

Certain specific printed security devices are known for facilitating such authentication but, by reason of their manner of use and limited visual effects, these known devices are primarily directed to trained or knowledgeable security personnel rather than for the use of lay persons. For example, U.S. Pat. No. 4,033,059 to Hutton et al describes an intaglio printing of two images, one being a background image and the other a latent image, using differing orientation or depths for the intaglio imprints such that the latent and background images are not discernible and appear as a single image when viewed from a normal viewing angle roughly perpendicular to the document but when viewed from the side (i.e. at a narrow angle to the plane of the document) the latent image stands out as an independent image separate and discernible from the background. According to that security device it is necessary to decrease the viewing angle (that is the angle to the plane of the document) in order to establish and then improve the visibility of the latent image. Similarly, U.S. Pat. No. 5,199,744 to Shenton describes a security device comprising a substrate which is embossed with a transitory image on one area of a substrate, the transitory image being visible at a specific angle only and not at other angles, and a linear area around the image which is visible at all angles, such that when the device is viewed at angles other than the specific viewing angle a uniform image is seen and the transitory image (being either a latent or transient image) is not discernible (this being discernible as a separate image only when viewed at the specific viewing angle). Thus, for both of these known security devices their effective use is directed to persons having knowledge of the applicable viewing angles.

Another example is a security device described in Canadian Patent No. 1,172,282 to Merry whereby a first line deflection pattern, defining a first image which is detectable by using a finding screen there over, overlays a second line deflection pattern, defining a second image which is detectable by using a finding screen there over, the two patterns being printed at different angles of orientation such that each image is separately detectable using a finding screen oriented at such different angles. Similarly, Canadian Patent No. 2,071,795 to Merry et al describes a security device comprising an array of micro-characters in which a group of the characters is phase-shifted relative to the others to collectively define an image, whereby the characters appear uniform when viewed by the naked eye and the image is not disvernible but with the aid of a finding screen the image becomes visible. Effective use of these security devices by persons requires such persons to be knowledgeable with respect to the such use and also requires a specific finding screen.

There is a need, therefore, for a security device which is useable without prior knowledge by the user. Further, there is a need for a security device which can be applied to a document using conventional printing and is relatively simple and avoids high manufacturing costs. Still further, there is a need for a security device which provides a distinct visual effect as compared with those created by the known latent and transient images described in the foregoing patent references.

SUMMARY OF THE INVENTION

In accordance with aspects of the invention there are provided a printed security device for a document and a method of making the same. An intaglio printed latent image is printed onto a substrate using a highly reflective ink, such that the intaglio printed latent image is visible when viewed within a first angle range extending from near-vertical to the plane of the latent image towards the image and also within a second angle range closer to the plane of the image, and is not visible when viewed within an angle range between the first and second angle ranges. In the result, a change in viewing angle from one angle range to an adjacent angle range results in a visible latent image becoming invisible or vice versa (producing a flip-flop image visibility effect).

In accordance with a further aspect of the invention a second image is printed by non-intaglio printing, such that the second image is visible when viewed within a third angle range between the first and second angle ranges (for example, in the illustrated embodiment the third angle range commences at about 12°–17° from the vertical to the plane of the image) and is not visible when viewed at other angles. In the result, a change in viewing angle between the first angle range and the third angle range results in a visible latent image becoming invisible and an invisible non-intaglio printed second image to become visible, or vice versa. Also, a change in viewing angle between the third angle range and the second angle range results in a visible non-intaglio printed second image becoming invisible and an invisible latent image to become visible, or vice versa (thereby also producing a flip-flop image visibility effect but with the improvement of the visible images alternating between the distinct latent and second images).

Preferably the highly reflective ink is a bright metallic ink comprising, by weight percentage, 30%–60% varnish, 0–15% solvent, 0–5% wax, 24%–60% metallic pigment and 0–5% drier. The second image is printed using an iridescent ink which may, for example, comprise, by weight percentage, about 65% clear varnish, about 23% thinner and about 12% iridescent pigment. Preferably the second image is printed by screen printing over the substrate and the intaglio printed latent image is printed over the second image.

DESCRIPTION OF THE DRAWINGS

The present invention is described below with reference to the following drawings in which like reference numerals refer throughout to like elements.

DESCRIPTION OF THE ILLUSTRATED EMBODIMENT

Figure 1:
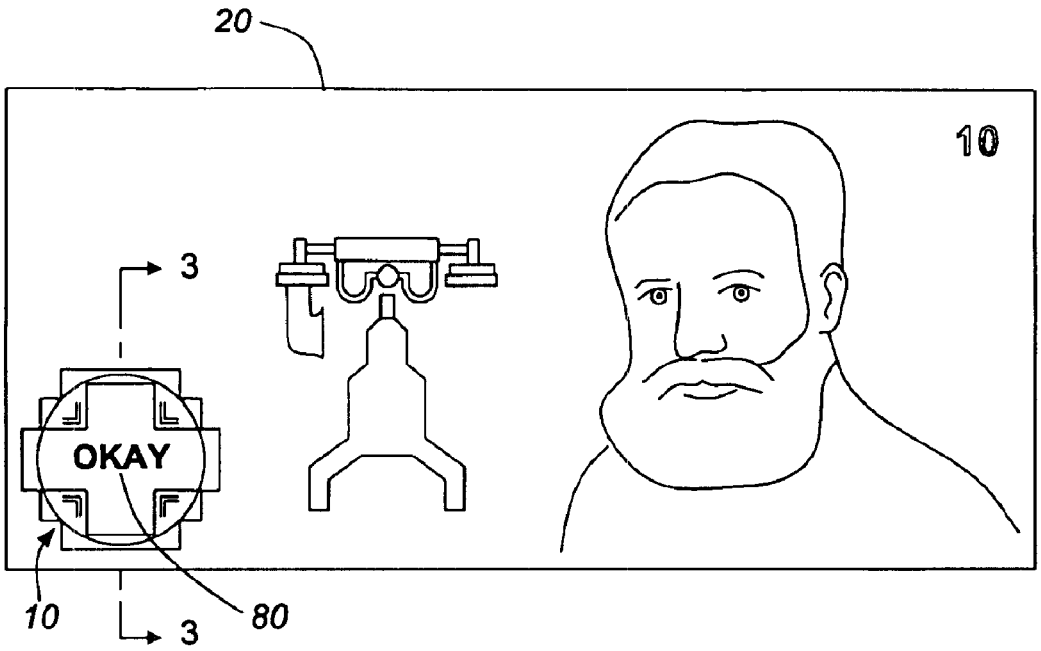
FIG. 1 is an exemplary depiction of a bank note on which there has been printed a security device in accordance with the invention, whereby the appearance of the security device when viewed at a near-vertical angle to the plane of the image is shown, such that an intaglio printed latent image (viz. the word "OKAY" in this example) associated with that near-vertical angle is visible.

Prior to the present invention it had been believed by persons skilled in the art of intaglio printing that intaglio printed latent images are subject to becoming visible at low angles (acute to the plane of the image) only and that they are not subject to becoming visible at angles close to the vertical (perpendicular to the plane of the image), the reason being that this was the effect which resulted from the differing orientation or depths for the intaglio imprints defining the latent image (for a basic description of the making of an intaglio printed latent image reference may be made, for example, to U.S. Pat. No. 4,033,059 to Hutton et al). For example, this effect is taught in U.S. Pat. No. 5,199,744 to Shenton at column 6, lines 19–21, wherein it is taught to use a perimeter line around an intaglio printed latent image in order to be able to identify the area of the latent image from above, it being alleged therein that latent images are designed only to be revealed a low angle viewing.

The inventors have made the unexpected and surprising finding that by using a highly reflective intaglio ink (alternatively referred to herein as a bright metallic intaglio ink) to intaglio print a latent image, the visibility of the latent image is caused to change markedly over that which applies when a non-reflective (regular) intaglio ink is used. Specifically, when a highly reflective intaglio ink is used the latent image is visible at a viewing angle close to 90 degrees (i.e. close to the vertical from the image plane) in addition to being visible at the prior low viewing angle (i.e. an acute angle to the image plane). In the context of the foregoing prior art latent images, this close to vertical visibility of the latent image would be undesirable since the intention there is that the latent image be secret and known only by those knowledgeable person assigned to search for them for purposes of authenticating a document. However, the inventors recognize that this dual high-low angle imaging is, in and of itself, a useful advancement for securing and authenticating a document because such an ability to see the image on a printed security device, upon a normal (i.e. close to vertical) viewing of the document, enables lay persons to assess the authenticity of the security device. At the same time, a simple handling of the security device, moving it slowly in different directions to continuously change the viewing angle from high to low, results in a repetitive appearance and disappearance of the latent image, since it becomes visible at high and low angles and invisible at angles between them, thereby establishing a hologram or "flip-flop"-type visual effect for the security device.

The specific angles of visibility of an intaglio latent image printed with a highly reflective intaglio ink will vary from one intaglio print situation to another because the viewing angles associated with any given latent image are dependent upon design variations and the orientation, widths and heights of the engraved lines. Also, the intensity and direction of the light source for a given viewing situation will affect the visibility of the latent image the angle at which the light falls on the document (for example, whether the viewer is facing a window or, instead, is sideways to it, will result in the flip-flop effect occurring at different angles). However, in general, for an intaglio latent image printed with a highly reflective intaglio ink, it is found by the inventors that the intaglio printed latent image is visible when viewed within a first angle range extending from near-vertical to the plane of the latent image (i.e. approximately 90° to the plane of the image) towards the image and also within a second angle range separate from the first angle range and extending from closer to the plane of the image (i.e. approximately 10° to the plane of the image) towards the plane of the image (i.e. the horizontal). The latent image is not visible when viewed within an angle range between these first and second angle ranges. Thus, a change in viewing angle from one angle range to an adjacent angle range (i.e. moving from an angle within the first angle range to an angle within the angle range between the first and second angle ranges or vice versa, or from an angle within the angle range between the first and second ranges to an angle within the second angle range or vice versa) results in a visible latent image becoming invisible or an invisible latent image becoming visible. It is the foregoing first angle range, starting about the vertical to the image, which is new and which does not occur for intaglio latent images printed with regular (i.e. not highly reflective) inks.

Figure 2:
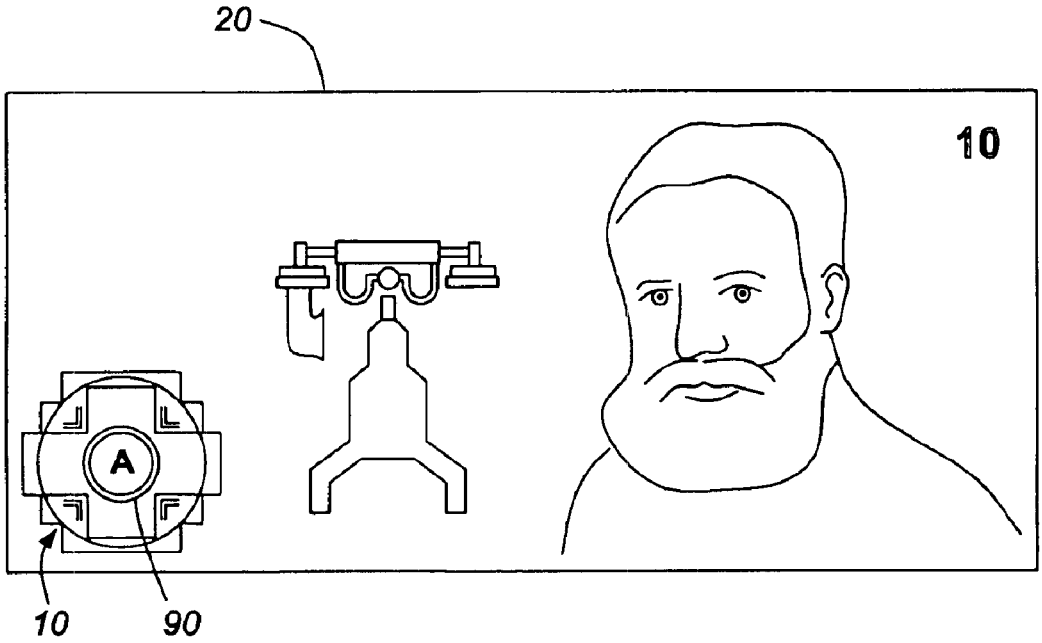
FIG. 2 is a further depiction of the bank note of FIG. 1, with security device, but as seen at a different viewing angle (e.g. 17° in this exemplary embodiment) which is within an angle range adjacent to a first angle range of visibility for the latent image of FIG. 1, whereby a non-intaglio printed second image (viz. the letter "A" with a circle design" in this example) associated with this different viewing angle is visible instead of the latent image shown in FIG. 1; and, FIG. 3 is an exaggerated cross-sectional view of the security device shown in FIG. 1 (or FIG. 2) taken at section I—I, illustrating the substrate and print layers of the security device of the document shown by FIGS. 1 and 2.

In addition, the inventors have developed an even further improved security device 10 comprising two separately printed and distinct images 80, 90, whereby each becomes visible when viewed at a different angle, or range of angles, than the other, the resulting visual effect being a distinct flip-flopping between the two images as the document 20 is handled. Examples of these two images 80, 90, one being an intaglio printed latent image 80 and the other being a non-intaglio printed image 90, are depicted by FIGS. 1 and 2. Advantageously, the use of intaglio printing enhances the degree of security of the document because intaglio printing is inherently more secure than other types of printing due to the specialized, expensive printing equipment needed to perform intaglio printing.

The intaglio printed latent image 80 is printed using a highly reflective ink and provides a high angle visibility (in fact, a dual high-low visibility). A second printed image 90, using a non-intaglio form of printing and an iridescent ink, provides a mid-angle visibility whereby the second image is visible when viewed at an angle within a third angle range between the first and second angle ranges of visibility of the latent image 80. Thus, the latent image 80 is visible at near-vertical angles to the plane of the security device. Then, when the viewing angle is moved away from those near-vertical angles and becomes within the third angle range of visibility of the second image (this angle being closer to the horizontal of the plane of the security device but not so close as to reach the low viewing angle range of the latent image 80), the non-intaglio printed second image 90 becomes visible. Again, it is to be understood that it is not possible to precisely specify the viewing angle ranges for the images 80, 90, since this depends on many variable factors including the intensity and direction of the light source. For the illustrated embodiment (according to which the non-intaglio image 90 is printed first, before the intaglio printing is applied, using a particular selected iridescent ink and silkscreen printing) the non-intaglio image 90 becomes visible at about 12°–17° from the vertical to the plane of the image and remains visible within a third angle range which is between the first and second angle ranges of visibility of the intaglio image. Thus, a change in viewing angle from one angle range to an adjacent angle range (i.e. from the first to third angle range or vice versa, or from the third to second angle range or vice versa) results in a visible latent image becoming invisible and an invisible second image becoming visible, or vice versa.

Figure 3:
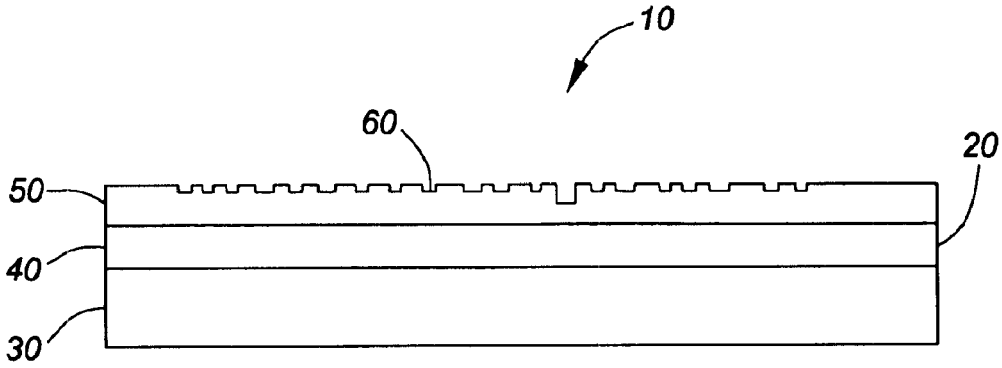

For the illustrated embodiment of the security device 10, the images 80, 90 occupy print layers 50, 40, respectively, over a substrate 30 which is of a sufficiently high quality to receive intaglio printing e.g. bank note paper (see FIG. 3). In this example, the non-intaglio printed image 90 is printed firstly, to form a first print layer 40 over the substrate 30, using a screen press. Advantageously, screen printing is capable of laying down a heavy ink film, as compared with other non-intaglio printing methods such as lithography, gravure, flexography and letterpress, and this is pertinent because the visibility of iridescent ink images, such as image 90, is dependent on the thickness of the ink film deposited. By appropriate selection of the ink used for this printing, and configuration of the printed image, the non-intaglio printed second image 90 becomes visible only within a predetermined angle range at which the latent image is no longer visible i.e. the image 90 becomes invisible at angles outside the predetermined angle range of visibility therefore (referred to herein as the third angle range).

To achieve this complementary visibility of the non-intaglio image 90, a suitable iridescent ink (i.e. an ink having iridescent pigments) is selected for use, such inks being well known in the printing industry and a person skilled in this industry being readily able to make a suitable selection. For the illustrated embodiment the ink formation set out below under Table A, is used for silkscreen printing of the non-intaglio image 90. It is to be understood that although the non-intaglio image 90 is preferably printed first according to the illustrated embodiment, and the intaglio latent image is printed thereafter, it also possible to print the latent image first and then print the second non-intaglio image over it. Also, it is to be understood that although the preferred printing method is to use a screen press for the non-intaglio image 90, it is possible to use other printing methods such as lithography, flexography or gravure printing.

TABLE A

Ink Formulation for Sample Silkscreen Printed Image

| Component | Amount (by weight percentage) |
|---|---|
| MPI 170[1] clear varnish | 65 |
| MPI 182G[1] thinner | 23 |
| Afflair 205[2] pigment | 12 |
| Total: | 100 |

Notes:
[1]Product identifier, available from Tecknecal Screen Print Supplies Inc. of Clarence Creek, Ontario, Canada.
[2]Product identifier, available from EM Industries of Hawthorne, New York, U.S.A.

If desired, this ink may be formulated to have other special properties, in addition to being visible only within a predetermined angle range, such as being fluorescent, phosphorescent or thermochromic.

For the illustrated embodiment, the intaglio printing of the latent image 80 is performed secondly using a highly reflective ink so that the image 80 is visible at a close to vertical angle from the plane of the image. The intaglio imprints 60 define a second print layer 50 over the first print layer 40. The highly reflective ink used for the illustrated embodiment is the bright metallic intaglio ink developed by the assignee of the present invention as described in U.S. Pat. No. 6,063,176. Other bright metallic inks suitable for use are well known by persons skilled in the art and are readily available in the marketplace. These inks use metallic pigments, iridescent pigments, special effect pigments such as the Paliocrom* (*trademark) pigments available from BASF of Germany. The intaglio OVI* (*trademark) ink manufactured by Sicpa of Switzerland is also suitable for use. For the illustrated embodiment the ink formation set out below under Table B, is used for intaglio printing of the latent image 80.

TABLE B

Ink Formulation for Sample Intaglio Printed Image

| Component | Amount (by weight percentage) [and optional percentage range] |
|---|---|
| Varnish | 35 [30–60] |
| Solvent | 6 [0–15] |
| Wax | 3 [0–5] |
| Metallic pigment | 55 [25–60] |
| Driers | 1 [0–5] |
| Total: | 100 |

Persons skilled in the field of security printing will be readily able to apply the present invention to implement various applications of the same. Consequently, it is to be understood that the particular embodiment described herein by way of illustration is not intended to limit the scope of the invention claimed herein by the inventors and defined by the appended claims.

What is claimed is:

1. A printed security device for a document, said security device comprising an intaglio printed latent image which has been printed onto a substrate using a highly reflective ink, wherein said intaglio printed latent image is visible when viewed within a first angle range extending from near-vertical to the plane of said latent image towards said image and also within a second angle range closer to the plane of the image, and is not visible when viewed within an angle range between said first and second angle ranges, whereby a change in viewing angle from one said angle range to an adjacent angle range results in a visible said latent image becoming invisible or an invisible said latent image becoming visible.

2. A printed security device according to claim 1 and further comprising a non-intaglio printed second image, wherein said second image is visible when viewed within a third angle range between said first and second angle ranges and is not visible when viewed at other angles, whereby a change in viewing angle between said first angle range and said third angle range results in a visible said latent image becoming invisible and an invisible said non-intaglio printed second image becoming visible or vice versa.

3. A printed security device according to claim 2 whereby a change in viewing angle between said third angle range and said second angle range results in a visible said non-intaglio printed second image becoming invisible and an invisible said latent image becoming visible or vice versa.

4. A printed security device according to claim 1 wherein said highly reflective ink is a bright metallic ink comprising, by weight percentage, 30%–60% varnish, 0–15% solvent, 0–5% wax, 24%–60% metallic pigment and 0–5% drier.

5. A printed security device according to claim 3 wherein said second image is printed using an iridescent ink.

6. A printed security device according to claim 5 wherein said highly reflective ink is a bright metallic ink comprising, by weight percentage, 30%–60% varnish, 0–15% solvent, 0–5% wax, 24%–60% metallic pigment and 0–5% drier.

7. A printed security device according to claim 6 wherein said iridescent ink comprises, by weight percentage, about 65% clear varnish, about 23% thinner and about 12% iridescent pigment.

8. A printed security device according to claim 7 wherein a print layer defined by said non-intaglio printed image is between said substrate and a print layer defined by said intaglio printed latent image.

9. A printed security device according to claim 8 wherein said non-intaglio printed image becomes visible at about 12°–17° from the vertical to the plane of the image.

10. A method of making a printed security device for a document, said method comprising intaglio printing a latent image onto a substrate using a highly reflective ink, whereby said intaglio printed latent image is visible when viewed within a first angle range extending from near-vertical to the plane of said latent image towards said image and also within a second angle range closer to the plane of the image, and is not visible when viewed within an angle range between said first and second angle ranges, such that a change in viewing angle from one said angle range to an adjacent angle range results in a visible said latent image becoming invisible or an invisible latent image becoming visible.

11. A method according to claim 10 and further comprising non-intaglio printing a second image, whereby said second image is visible when viewed within a third angle range between said first and second angle ranges and is not visible when viewed at other angles, such that a change in viewing angle between said first angle range and said third angle range results in a visible said latent image becoming invisible and an invisible said second image becoming visible or vice versa.

12. A method according to 11 whereby a change in viewing angle between said third angle range and said second angle range results in a visible said second image becoming invisible and an invisible said latent image becoming visible or vice versa.

13. A method according to claim 10 whereby said highly reflective ink is a bright metallic ink comprising, by weight percentage, 30%–60% varnish, 0–15% solvent, 0–5% wax, 24%–60% metallic pigment and 0–5% drier.

14. A method according to claim 12 whereby said second image is printed using an iridescent ink.

15. A method according to claim 14 whereby said highly reflective ink is a bright metallic ink comprising, by weight percentage, 30%–60% varnish, 0–15% solvent, 0–5% wax, 24%–60% metallic pigment and 0–5% drier.

16. A method according to claim 15 whereby said second image is printed by screen printing.

17. A method according to claim 16 whereby said iridescent ink comprises, by weight percentage, about 65% clear varnish, about 23% thinner and about 12% iridescent pigment.

18. A method according to claim 17 whereby said second image is printed over said substrate and said intaglio printed latent image is printed over said second image.

19. A method according to claim 18 whereby said second image becomes visible at about 12°–17° from the vertical to the plane of the image.

* * * * *